US007562624B2

(12) United States Patent
Iwasaki et al.

(10) Patent No.: US 7,562,624 B2
(45) Date of Patent: Jul. 21, 2009

(54) PRINTING BLANKET

(75) Inventors: Yoshio Iwasaki, Kanagawa (JP); Hiroyuki Hori, Kanagawa (JP)

(73) Assignee: Kabushiki Kaisha Meiji Gomu Kasei, Tokyo (JP)

( * ) Notice: Subject to any disclaimer, the term of this patent is extended or adjusted under 35 U.S.C. 154(b) by 486 days.

(21) Appl. No.: 10/533,261

(22) PCT Filed: Oct. 21, 2003

(86) PCT No.: PCT/JP03/13422

§ 371 (c)(1),
(2), (4) Date: Jun. 22, 2005

(87) PCT Pub. No.: WO2004/037547

PCT Pub. Date: May 6, 2004

(65) Prior Publication Data

US 2006/0060095 A1 Mar. 23, 2006

(30) Foreign Application Priority Data

Oct. 28, 2002 (JP) ..... 2002-312812

(51) Int. Cl.
*B41F 27/06* (2006.01)

(52) U.S. Cl. ..... 101/376; 101/375

(58) Field of Classification Search ..... 101/376, 101/375

See application file for complete search history.

(56) References Cited

U.S. PATENT DOCUMENTS

| | | | | |
|---|---|---|---|---|
| 1,492,123 | A * | 4/1924 | Decker | 442/257 |
| 5,352,507 | A * | 10/1994 | Bresson et al. | 428/35.9 |
| 5,366,799 | A * | 11/1994 | Pinkston et al. | 442/260 |
| 5,431,989 | A * | 7/1995 | Beltzung et al. | 428/218 |
| 6,148,725 | A * | 11/2000 | Knauer et al. | 101/217 |
| 6,182,568 | B1 * | 2/2001 | Ogita et al. | 101/376 |
| 6,205,922 | B1 * | 3/2001 | Henry et al. | 101/376 |
| 6,287,638 | B1 * | 9/2001 | Castelli et al. | 427/381 |
| 6,530,321 | B2 * | 3/2003 | Andrew et al. | 101/376 |
| 6,645,601 | B1 * | 11/2003 | Serain et al. | 428/121 |
| 7,399,526 | B2 * | 7/2008 | Dalmais et al. | 428/344 |

* cited by examiner

*Primary Examiner*—Anthony H. Nguyen
(74) *Attorney, Agent, or Firm*—Apex Juris, pllc; Tracy M Heims

(57) ABSTRACT

In a printing blanket comprising a reinforcement layer formed of more than one sheet of fabric, a compressive layer, and a surface rubber layer laid through a supporting body, the compressive layer is separated by a separation layer so as to be divided into two layers of a first compressive layer and a second compressive layer. Because the compressive layer is formed in a two-layer construction, normal printing pressure and abruptly applied excessive printing pressure can be efficiently absorbed. It is preferable that the first compressive layer close to the surface rubber layer has an air space amount of 0.10-0.20 mm, and the entire part of the first compressive layer and second compressive layer has an air space amount of 0.25 mm or more. It is also preferable that the hardness of the compressive layer is 50-90 JIS-A, and the separation layer has a hardness of 50 JIS-A-80 JID-D and a thickness of 0.05 mm.

6 Claims, 2 Drawing Sheets

PRINTING BLANKET

BACKGROUND OF THE INVENTION

1. Field of the Invention

The invention relates to a printing blanket used for an offset printing press and more particularly to a printing blanket having a compressive layer.

2. Description of the Related Art

In an offset printing press, an image of a lithographic plate is printed on a paper through a blanket, and after the image of the lithographic plate is copied on the blanket, the image on the blanket is printed on the paper. In such a blanket used for an offset printing press, there is a compressive blanket having a compressive layer with a porous layer.

Based on FIG. 2, an example of a compressive blanket will be explained below. The compressive blanket comprises a reinforcement layer 3 laid in two to three layers of fabrics 1 such as cotton cloth, rayon cloth, and polyester cloth through adhesive layers 2 such as rubber cement, a compressive layer 4 which is a fine porous layer formed by foaming of a foaming agent on the reinforcement layer 3, a supporting body 5 made of cotton cloth laid on the compressive layer 4, and a surface rubber layer 6 laid on the supporting body 5. Coater such as knife coater and blade coater is used to lay said surface rubber layer 6 on the supporting body 5.

An object of having a compressive layer is to prevent a blur that a picture image becomes unclear when uneven pressure is applied on a printing surface. Another object is to cushion and absorb the shock that is applied when two or more sheets of paper are accidentally inserted during the printing process, to absorb damage of the blanket, or to protect the blanket from damaging the printing quality. Another purpose is to maintain the flatness and thickness of the printing surface by restoring the blanket compressed in the nip portion of a printing machine to the normal thickness. A compressive printing blanket is used for a high speed offset printing press to accomplish such purposes as well as obtain clear printing images.

However, as mentioned above, even though a blanket has a compressive layer, the change in pressure cannot be absorbed completely, creating a streak defect (shock eye) and a smash trouble. A streak defect is a defect, which creates a horizontal stripe on a printed material because the printing pressure changes with a rapid change in pressure and vibration caused when a cylinder gap section of a printing machine passes through a nip. It is also called a shock eye because a streak defect is that a shock generated in a printing machine affects a printed material. A smash trouble is also a defect, which dents a blanket because when a printing paper is tore during the printing process, and two or more papers go into the nip, a compressed blanket cannot be restored to the normal thickness. A blanket with low compressibility is used to aair space a streak defect (shock eye) and smash trouble. However, although a streak defect (shock eye) is somewhat improved by using a blanket with low compressibility, the ink transition pressure between a printing cylinder and a blanket drum and between a blanket drum and an impression cylinder (pressure between nips) declines, deteriorating printing quality (poor ink impression). Moreover, even if a blanket with low compressibility is used, the compressive amount (the amount of air space) of a conventional compressive blanket is limited, and it cannot respond to a smash trouble when excessive printing pressure is momentarily applied, thereby denting the blanket. In this specification, the amount of air space means the total of the thickness of air space occupied to a vertical section in a compressive layer.

Therefore, it is an object of the invention to provide a printing blanket designed to reduce a streak defect (shock eye) while maintaining printing quality. It is also an object of the invention to provide a printing blanket in order to reduce a smash trouble while maintaining printing quality.

SUMMARY OF THE INVENTION

The invention has the following configuration to achieve the above-mentioned objects. In a printing blanket of the invention comprising a reinforcement formed of one or more sheets of fabric, a compressive layer, and a surface rubber layer laid through a supporting body, the compressive layer is separated by a separation layer so as to be divided into two layers. The two compressive layers can be formed such that each has a different amount of air space. As mentioned above, by forming a compressive layer into a two-layer structure, normal printing pressure can be absorbed by the first compressive layer close to a surface rubber layer, and excessive printing pressure applied rapidly can be absorbed by the second compressive layer. The separation layer can be formed by one or more layers of elastomer. It is preferable that the first compressive layer close to the surface rubber layer has an air space amount of 0.10-0.20 mm, and the entire part of the first compressive layer and second compressive layer has an air space amount of 0.25 mm or more. By forming the amount of air space of the first compressive layer and second compressive layer as stated above, it is effective to reduce a streak defect (shock eye) and smash trouble.

It is also preferable that the compressive layer has a hardness of 50-90 JIS-A. By making a matrix hardness of a compressive layer 50-90 JIS-A, the ink coverage of the solid section improves. Moreover, it is preferable that the separation layer has a hardness of 50 JIS-A-, 80 JIS-D and a thickness of 0.05 mm or more. The ink coverage of the solid section improves by making a hardness of the separation layer 50 JIS-A -80 JIS-D and a thickness 0.05 mm or more.

DETAILED DESCRIPTION OF THE INVENTION

Figure 1:
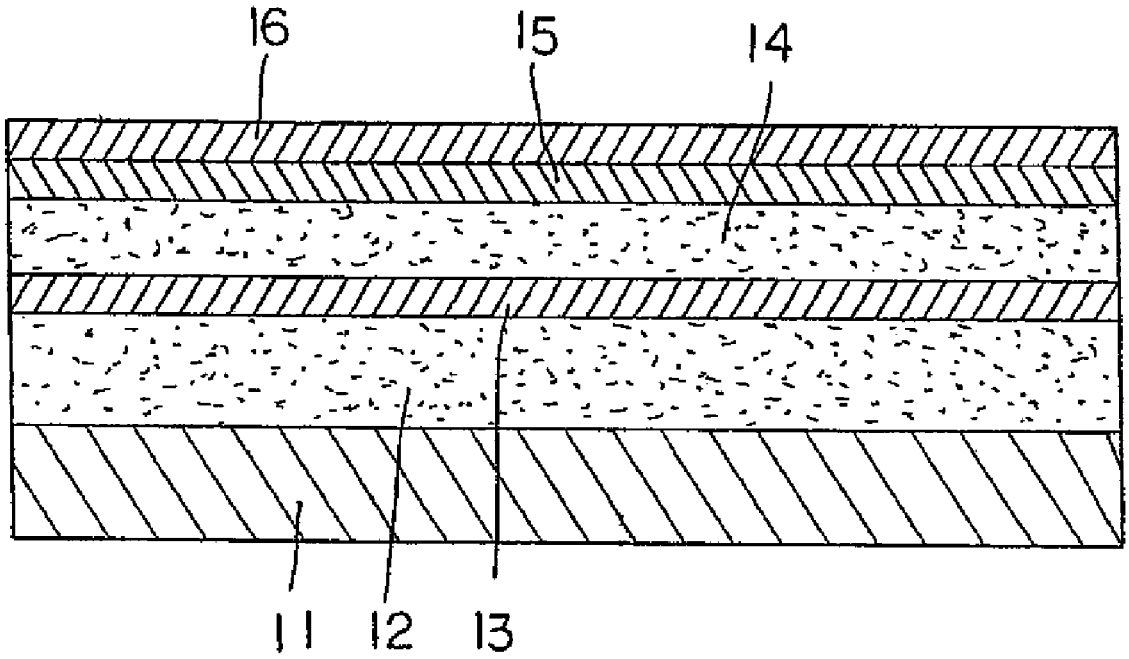
FIG. 1 is a sectional view of a printing blanket of the invention.

To explain the invention in more detail below, it will be explained, following the attached drawings. FIG. 1 shows an preferred printing blanket of the invention where a compressive layer is separated by a separation layer so as to be divided into two layers, and the separation layer is emphasized to facilitate understanding. The blanket having a compressive layer is formed by laminating a reinforcement layer 11, a second compressive layer 12, a separation layer 13, a first compressive layer 14, a supporting body 15, and a surface rubber layer 16. The reinforcement layer 11 is formed by laminating one or more sheets of heretofore known fabric 1 such as cotton cloth, rayon cloth, and polyester cloth with an adhesive layer like rubber cement. The reinforcement layer 11 is equivalent to a reinforcement layer 3 of a conventional printing blanket shown in FIG. 2.

Moreover, the first compressive layer and second compressive layer can be formed by a heretofore known means. For example, a hollow minute ball is blended with glass, phenol resin, and thermoplastics ingredient by a foaming method, thereby blending a foaming agent in a synthetic-rubber compound which forms a compressive layer, fine particles such as sodium chloride and sugar which can be eluted in an eluate like water and methanol are blended in a synthetic-rubber compound by a hollow minute ball mixing method which forms an independent cell, and it can be formed by a method such as fine particles melting method which elutes after vulcanization.

An oilproof polymer is used for the surface layer 16 in consideration of printing ink and ink washing solvent, etc. The surface layer 16 can be formed by for example, polychloroprene rubber (CR), polysulfide rubber (T), polyacrylonitrile butadiene rubber (NBR), fluororubber (FKM), silicone rubber (Q), etc. Such an oilproof polymer may be added with one or more kinds, such as vulcanizing agent, vulcanization accelerator, reinforcing agent and antioxidant.

It is preferable that the first compressive layer close to the surface rubber layer has an air space amount of 0.10-0.20 mm, and the entire part of the first compressive layer and second compressive layer has an air space amount of 0.25 mm or more. This is because if the air space amount of the first compressive layer is 0.10 mm or less, normal printing pressure cannot be fully absorbed, and if it is 0.20 mm or more, the ink coverage of a solid section falls.

Moreover, it is preferable that the compressive layer has a matrix hardness of 50-90 JIS-A. This is because if the compressive layer has a matrix hardness of 50 JIS-A or less, the ink coverage of a solid section falls, and if the compressive layer has a matrix hardness of 90 JIS-A or more, the rate of 50% halftone dot area (dot gain) and mountability fall.

The separation layer is formed by one or more layers of elastomer. It is preferable that the separation layer has a hardness of 50 JIS-A-80 JIS-D and a thickness of 0.5 mm or more. This is because if the hardness is 50 JIS-A or less, the ink coverage of a solid section falls, and if the hardness is 80 JIS-D or more, the mountability falls. If the separation layer has a thickness of 0.5 mm or less, it receives an influence from the second compressive layer, and the compressive layer cannot be divided into two layers, and the ink coverage of a solid section falls.

The printing blanket according to the invention provides the following benefits. Because the compressive layer is divided into two layers by the separation layer, normal printing pressure can be absorbed by the first compressive layer close to the surface rubber layer, and rapid change in printing pressure can be absorbed by the second compressive layer. Therefore, the structure of the invention is effective to reduce a streak defect (shock eye) and a smash trouble, thereby improving the ink coverage of a solid section.

EXAMPLES (Relations between the sum of an air space of the first compressive layer and second compressive layer, a streak defect (shock eye), a smash trouble and printing quality (ink deposition properties))

Figure 2:
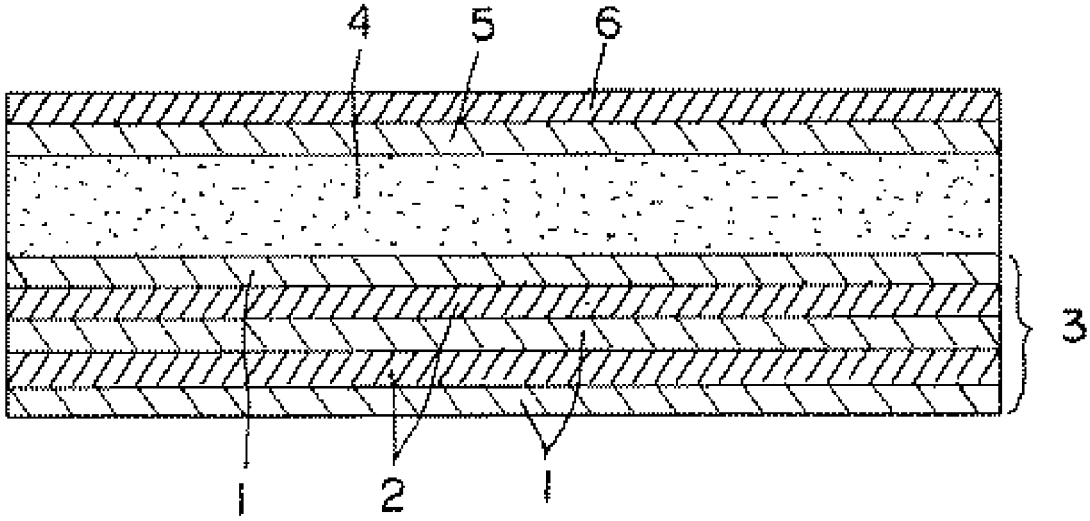
FIG. 2 PRIOR ART
FIG. 2 is a sectional view of a conventional printing blanket.

As shown in FIG. 2, a reinforcement layer 3 laminated by three sheets of fabric, a compressive layer 4, a supporting body 5 and surface rubber layer 6 are laminated in the blanket of the comparative example. As shown in FIG. 1, a reinforcement layer 11 laminated by fabrics like the comparative example, a second compressive layer 12, a separation layer 13, a first compressive layer 14, a supporting body 15 and a surface rubber layer 16 are laminated in the blanket of the embodiment. The separation layer has a thickness of 0.10 mm (80 JIS-A), an air space of the first compressive layer of 0.15 mm (70 JIS-A), and the sum of an air space of the first compressive layer and second compressive layer is shown in Table 1.

TABLE 1

| | Comparative example 1 | Comparative example 2 | Comparative example 3 | Comparative example 4 | Embodiment 1 | Embodiment 2 | Embodiment 3 |
|---|---|---|---|---|---|---|---|
| Air space of the first compressive layer (mm) | 0.18 | 0.24 | 0.15 | — | — | — | — |
| Air space of the second compressive layer (mm) | — | — | 0 | 0.05 | 0.10 | 0.15 | 0.20 |
| Air space of the first compressive layer and second compressive layer (mm) | 0.18 | 0.24 | 0.15 | 0.20 | 0.25 | 0.30 | 0.35 |
| Remarks | Normal compression modulus BL | Low compression modulus BL | — | — | — | — | — |

(Evaluation of a Streak Defect)

First, a streak default was evaluated. Printing conditions and used measuring equipment were as follows. Komori RISURON 226 was used for a printing machine, the printing speed was 10,000 sheets per hour, the printing pressure was P/B=0.10 mm, B/I=0.15 mm, and the lithographic plate was a total 70 % halftone dot, the ink was Indigo blue M and Red M from Toyo Inc. High ECO, the paper was O.K. mirror coat platinum, the thickness was 0.25 mm, the concentration meter was Gretag D196, the standard concentration was Indigo blue 1.45-1.50, Red 1.30-1.35, and the image processing system was KD systems DA 6000.

The testing method was as follows. First, a sample was bound tight to a printing machine with the standard thickness (P/B=0.10 mm) by a special torque wrench and attached with torque 38 N·m. Then, printing was made at a speed of 10,000 sheets an hour, and the printing machine was stopped when about 100 sheets were printed. Here, the sample was bound tight again with torque 38 N·m by a special torque wrench to amend a slack of the sample.

A total 70% halftone dot printing was made, adjusting the supply of ink, and the concentration was adjusted to the standard concentration. The standard concentration was Indigo blue 1.45-1.50, Red 1.30-1.35, and the concentration meter was Gretag D196. 210 or more sheets were printed (concentration adjustment would be completed during the period), and 20 sheets were taken from 190-209 sheets. The color difference (ΔE*ab) between the neighborhood close to the shock eye and the shock eye of the taken printing papers was determined with Gretag D196 and evaluated. The criteria of judgment was based on the criteria for evaluation extracted from the description of Gretag D196. The criteria for evaluation is shown in Table 2.

TABLE 2

| Color difference | | Criteria of our judgment |
|---|---|---|
| 0-0.5 | Negligibly different | ○ |
| 0.5-1.5 | Slightly different | Δ |
| 1.5-3.0 | Sensibly different | X |
| 3.0-6.0 | Notably different | X |
| 6.0-12.0 | Extremely different | X |
| 12 or more | Become a different color | X |

(Evaluation of a Smash Trouble)

Next, a smash trouble was evaluated. High-speed web rotary test machine 15M (this is a compression/rotary test machine (bearer contact method) where units of an impression cylinder of a printing machine and blanket drum are remodeled) was used, and as for the impression cylinder and blanket drum, the shell diameter was 173 mm in diameter and the field length W was 414 mm. The measuring condition was that a trial material (tape) 1620 from 3M (thickness 0.48 mm) was used, the printing pressure was set to be 0.4 mm, the bearer spacing was 0.1 mm, and the rotation speed was 100 rpm. Regarding the timing of measuring, it was measured after 0 rotation, 50 rotations, 100 rotations, 200 rotations, 300 rotations, 500 rotations, 700 rotations, 1,000 rotations respectively.

The testing method was as follows. First, an underlay and blanket were attached in the blanket drum so that the compressive amount of the blanket in the nip would become 0.40 mm, and the underlay was stretched on the drum with constant torque (200 kgf·cm) so as to contact a cylinder. The testing machine was rotated at a speed of 100 rpm. The sample surface was observed after 0 rotation, and the testing machine was stopped after 50 rotations, 100 rotations, 200 rotations, 300 rotations, 500 rotations, 700 rotations, 1,000 rotations respectively to observe the sample surface. The crack situation of the sample surface was evaluated visually. The criteria of judgment is shown in Table 3.

TABLE 3

| Condition of the blanket surface | Criteria of our judgment |
|---|---|
| No crack | ○ |
| Minor crack (level identifiable by a 25 × loupe) | Δ |
| Severe crack (level identifiable by eyes) | X |

(Evaluation of Printing Quality)

Evaluation of printing quality was made as follows. The printing condition and used measuring equipment were as follows. Komori Risuron 226 was used for a printing equipment, the printing speed was 10,000 sheets an hour, the printing pressure was P/B=0.10 mm, B/I=0.15 mm, the lithographic plate was chromarin system, the ink was Indigo blue M from Toyo Inc. High ECO, the paper was double-sided art 76.5 kg, the paper was a book size, the concentration meter was Gretag D196, the standard concentration was Indigo 1.55-1.60, and KS systems DA 6000 was used for the image processing system.

The testing method was as follows. First, a sample was bound tight to a printing machine with the standard thickness (P/B=0.10 mm) by a special torque wrench and attached with torque 38 N·m. Then, printing was made at a speed of 10,000 sheets an hour, and the printing machine was stopped when about 100 sheets were printed. Here, the sample was bound tight again with torque 38 N·m by a special torque wrench to amend a slack of the sample.

The concentration was adjusted to the standard concentration, adjusting the supply of ink. The standard concentration was Indigo 1.55-1.60, and the concentration meter was Gretag D196. 210 or more sheets were printed (concentration adjustment would be completed during the period), and 20 sheets were taken from 190-209 sheets. The image processing of a printing patch (ink coverage of solid section) was made and evaluated. The criteria for evaluation is shown in Table 4.

TABLE 4

| Ink coverage of solid section | Criteria of our judgment |
|---|---|
| 99 and more-100% | ○ |
| 98 and more-less than 99% | Δ |
| Less than 98% | X |

Evaluation results of the above mentioned streak default (shock eye), smash trouble, and printing quality (ink deposition properties) or so-called ink coverage of a solid section are shown in Table 5. As for the embodiment, all results were good.

TABLE 5

| | Comparative example 1 | Comparative example 2 | Comparative example 3 | Comparative example 4 | Embodiment 1 | Embodiment 2 | Embodiment 3 |
|---|---|---|---|---|---|---|---|
| Evaluation of streak default | X | ○ | X | Δ | ○ | ○ | ○ |
| Evaluation of smash trouble | X | X | X | X | ○ | ○ | ○ |
| Ink coverage of solid section | ○ | Δ | ○ | ○ | ○ | ○ | ○ |

(Relations Between the Amount of Air Space of the First Compressive Layer and Printing Quality)

First, the comparative example and embodiment have the amount of air space of the first compressive layer as shown in Table 6. The second compressive layer has the amount of air space of 0.15 mm (70 JIS-A), and the separation layer has a thickness of 0.10 mm (80 JIS-A).

TABLE 6

| | Comparative example 5 | Comparative example 6 | Embodiment 4 | Embodiment 2 | Embodiment 5 | Comparative example 7 |
|---|---|---|---|---|---|---|
| Amount of air space of the first compressive layer (mm) | 0.03 | 0.05 | 0.10 | 0.15 | 0.20 | 0.25 |

(Evaluation of Printing Quality)

Evaluation of printing quality was made as follows. The printing condition and used measuring equipment were as follows. Komori Risuron 226 was used for a printing equipment, the printing speed was 10,000 sheets an hour, the printing pressure was P/B=0.10 mm, B/I=0.15 mm, the lithographic plate was chromarin system, the ink was Indigo blue M from Toyo Inc. High ECO, the paper was double-sided art 76.5 kg, the paper was a book size, the concentration meter was Gretag D196, the standard concentration was Indigo 1.55-1.60, and KS systems DA 6000 was used for the image processing system.

The testing method was as follows. First, a sample was bound tight to a printing machine with the standard thickness (P/B=0.10 mm) by a special torque wrench and attached with torque 38 N·m. Then, printing was made at a speed of 10,000 sheets an hour, and the printing machine was stopped when about 100 sheets were printed. Here, the sample was bound tight again with torque 38 N·m by a special torque wrench to amend a slack of the sample.

The concentration was adjusted to the standard concentration, adjusting the supply of ink. The standard concentration was Indigo 1.55-1.60, and the concentration meter was Gretag D196. 210 or more sheets were printed (concentration adjustment would be completed during the period), and 20 sheets were taken from 190-209 sheets. The image processing of a printing patch (ink coverage of solid section) and the rate of 50% halftone dot area were measured and evaluated. The criteria for evaluation is shown in Table 7.

TABLE 7

| Rate of 50% halftone dot area by concentration meter | Criteria of our judgment |
|---|---|
| 10% or more-less than 15% | ○ |
| 15% or more-less than 20% | Δ |
| Less than 10%-20% or more | X |

Evaluation results of the above mentioned ink coverage of a solid section as well as rate of 50% halftone dot area (dot gain) are shown in Table 8. As for the embodiment, all results were good.

TABLE 8

| | Comparative example 5 | Comparative example 6 | Embodiment 4 | Embodiment 2 | Embodiment 5 | Comparative example 7 |
|---|---|---|---|---|---|---|
| Ink coverage of solid section | ○ | ○ | ○ | ○ | ○ | X |
| Rate of 50% halftone dot area (dot gain) | X | X | ○ | ○ | ○ | ○ |

(Relations Between a Matrix Hardness of a Compressive Layer, Printing Quality (Ink Deposition Properties) and Attachment)

First, the matrix hardness of a compressive layer regarding the comparative example and embodiment is as shown in Table 9. The first compressive layer and second compressive layer have an amount of air space of 0.15 mm and a thickness of the separation layer of 0.10 mm (80 JIS-A) respectively.

TABLE 9

| | Comparative example 8 | Embodiment 6 | Embodiment 7 | Embodiment 2 | Embodiment 8 | Embodiment 9 | Comparative example 9 |
|---|---|---|---|---|---|---|---|
| Compressive matrix hardness (JIS-A) | 40 | 50 | 60 | 70 | 80 | 90 | 95 |

(Evaluation of Printing Quality)

Evaluation of printing quality was made as follows. The printing condition and used measuring equipment were as follows. Komori Risuron 226 was used for a printing equipment, the printing speed was 10,000 sheets an hour, the printing pressure was P/B=0.10 mm, B/I=0.15 mm, the lithographic plate was chromarin system, the ink was Indigo blue M from Toyo Inc. High ECO, the paper was double-sided art 76.5 kg, the paper was a book size, the concentration meter was Gretag D196, the standard concentration was Indigo 1.55-1.60, and KS systems DA 6000 was used for the image processing system.

The testing method was as follows. First, a sample was bound tight to a printing machine with the standard thickness (P/B=0.10 mm) by a special torque wrench and attached with torque 38 N·m. Then, printing was made at a speed of 10,000 sheets an hour, and the printing machine was stopped when about 100 sheets were printed. Here, the sample was bound tight again with torque 38 N·m by a special torque wrench to amend a slack of the sample.

The concentration was adjusted to the standard concentration, adjusting the supply of ink. The standard concentration was Indigo 1.55-1.60, and the concentration meter was Gretag D196. 210 or more sheets were printed (concentration adjustment would be completed during the period), and 20 sheets were taken from 190-209 sheets. The image processing of a printing patch (ink coverage of solid section) was made, the rate of 50% halftone dot area was measured, and the evaluation was made. The criteria for evaluation is shown in Table 7.

Evaluation of the attachment (rigidity of blanket) was made as follows. The measuring condition and used measuring equipment were as follows. A blanket attachment testing machine (shell diameter phi 173 mm, field length omega=120°) was used for a testing machine, a blanket which has a length of 300 mm and width of 1 inch was used for the sample, and the load was 2 kg. The testing method was that the sample was attached to the measuring equipment, and weight of 2 kgf was placed at the tip of the sample.

The float length of the sample (length away from the cylinder) and height (distance from the cylinder) were measured, and the attachment was evaluated (the standard is 940A-II from Meiji Rubber & Chemical Co., Ltd.). The criteria for evaluation of the ink coverage of a solid section was based on Table 4, and the criteria for evaluation of the rate of 50% halftone dot area (dot gain) was based on Table 7. Evaluation results of doing these are shown in Table 10.

TABLE 10

| | Comparative example 8 | Embodiment 6 | Embodiment 7 | Embodiment 2 | Embodiment 8 | Embodiment 9 | Comparative example 9 |
|---|---|---|---|---|---|---|---|
| Ink coverage of solid section | X | ○ | ○ | ○ | ○ | ○ | ○ |
| Rate of 50% halftone dot area (dot gain) | ○ | ○ | ○ | ○ | ○ | ○ | X |
| Attachment | ○ | ○ | ○ | ○ | ○ | Δ | X |

※: Better than a standard product-○, Equal-Δ, Worse-X (Relations Between a Matrix Hardness of a Separation Layer, Printing Quality and Attachment)

A matrix hardness of a separation layer, printing quality and attachment were evaluated. First, the matrix hardness of a separation layer regarding the comparative example and embodiment is as shown in Table 11. The first compressive layer and second compressive layer have an amount of air space of 0.15 mm (70 JIS-A) and a thickness of the separation layer of 0.10 mm respectively.

TABLE 11

| | Comparative example 11 | Embodiment 9 | Embodiment 10 | Embodiment 11 | Embodiment 12 | Comparative example 12 |
|---|---|---|---|---|---|---|
| Hardness of separation layer (JIS-A, D) | 50* | 70* | 90* | 70* | 80* | 90* |

*: JIS-A

**: JIS-D (Evaluation of Printing Quality)

Evaluation of printing quality was as follows. The printing condition and used measuring equipment were as follows. Komori Risuron 226 was used for a printing equipment, the printing speed was 10,000 sheets an hour, the printing pressure was P/B=0.10 mm, B/I=0.15 mm, the lithographic plate was chromarin system, the ink was Indigo blue M from Toyo Inc. High ECO, the paper was double-sided art 76.5 kg, the paper was a book size, the concentration meter was Gretag D196, the standard concentration was Indigo 1.55-1.60, and KS systems DA 6000 was used for the image processing system.

The testing method was as follows. First, a sample was bound tight to a printing machine with the standard thickness (P/B=0.10 mm) by a special torque wrench and attached with torque 38 N·m. Then, printing was made at a speed of 10,000 sheets an hour, and the printing machine was stopped when about 100 sheets were printed. Here, the sample was bound tight again with torque 38 N·m by a special torque wrench to amend a slack of the sample.

The concentration was adjusted to the standard concentration, adjusting the supply of ink. The standard concentration was Indigo 1.55-1.60, and the concentration meter was Gretag D196. 210 or more sheets were printed (concentration adjustment would be completed during the period), and 20 sheets were taken from 190-209 sheets. The image processing of a printing patch (ink coverage of solid section) was made and evaluated. The criteria for evaluation is shown in Table 4.

(Evaluation of Attachment)

Evaluation of the attachment or rigidity of blanket was made as follows. The measuring condition and used measuring equipment were as follows. A blanket attachment testing machine (shell diameter phi 173 mm, omega=120°) was used for a testing machine, a blanket which has a length of 300 mm and width of 1 inch was used for the sample, and the load was 2 kg. The testing method was that the sample was attached to the measuring equipment, and weight of 2 kgf was placed at the tip of the sample. The float length of the sample (length away from the cylinder) and height (distance from the cylinder) were measured, and the attachment was evaluated (the standard is 940A-II from Meiji Rubber & Chemical Co., Ltd.). Evaluation of the ink coverage of a solid section was made based on the above mentioned Table 4. Evaluation results of the ink coverage of a solid section through doing these are shown in Table 12. All results regarding the embodiment were good.

TABLE 12

| | Comparative example 11 | Embodiment 9 | Embodiment 10 | Embodiment 11 | Embodiment 12 | Comparative example 12 |
|---|---|---|---|---|---|---|
| Ink coverage of solid section | X | ○ | ○ | ○ | ○ | ○ |
| Attachment | ○ | ○ | ○ | ○ | Δ | X |

※: Better than a standard product-○, Equal-Δ, Worse-X (Relations Between a Thickness of the Separation Layer and Printing Quality)

The structure of a blanket is as shown in FIG. 1. The thickness of the separation layer regarding the comparative example as well as embodiment is as shown in FIG. 13. The first compressive layer and second compressive layer have an amount of air space of 0.15 mm (70 JIS-A) respectively, and the separation layer has a matrix hardness of 80 JID-A.

TABLE 13

| | Comparative example 13 | Comparative example 14 | Embodiment 13 | Embodiment 2 | Embodiment 14 | Embodiment 15 |
|---|---|---|---|---|---|---|
| Thickness of separation layer (mm) | 0 | 0.03 | 0.05 | 0.10 | 0.20 | 0.30 |

(Evaluation of Printing Quality)

Evaluation of printing quality was made as follows. The printing condition and used measuring equipment were as follows. Komori Risuron 226 was used for a printing equipment, the printing speed was 10,000 sheets an hour, the printing pressure was P/B=0.10 mm, B/I=0.15 mm, the lithographic plate was chromarin system, the ink was Indigo blue M from Toyo Inc. High ECO, the paper was double-sided art 76.5 kg, the paper was a book size, the concentration meter was Gretag D196, the standard concentration was Indigo 1.55-1.60, and KS systems DA 6000 was used for the image processing system.

The testing method was as follows. First, a sample was bound tight to a printing machine with the standard thickness (P/B=0.10 mm) by a special torque wrench and attached with torque 38 N·m. Then, printing was made at a speed of 10,000 sheets an hour, and the printing machine was stopped when about 100 sheets were printed. Here, the sample was bound tight again with torque 38 N·m by a special torque wrench to amend a slack of the sample.

The concentration was adjusted to the standard concentration, adjusting the supply of ink. The standard concentration was Indigo 1.55-1.60, and the concentration meter was Gretag D196. 210 or more sheets were printed (concentration adjustment would be completed during the period), and 20 sheets were taken from 190-209 sheets. The image processing of a printing patch (ink coverage of solid section) was made and evaluated. The criteria for evaluation is shown in Table 4. The above mentioned evaluation results are shown in Table 14.

TABLE 14

| | Comparative example 13 | Comparative example 14 | Embodiment 13 | Embodiment 12 | Embodiment 14 | Embodiment 15 |
|---|---|---|---|---|---|---|
| Ink coverage of solid section | X | X | ○ | ○ | ○ | ○ |

As is clear from the above mentioned Table 14, as for the ink coverage of a solid section, the result of the comparative example was bad because of the influence of the second compressive layer, but the result of the embodiment was good because the first compressive layer and second compressive layer are separated by the separation layer.

As mentioned above, a printing blanket of the invention is effective as a printing blanket which can deal with a rapid change in printing pressure and is excellently durable against repetitious compression, and it is especially suitable to be used as a blanket for a high-speed printing machine.

What we claim is:

1. A printing blanket, comprising a reinforcement layer formed of at least one sheet of fabric, a compressive layer, and a surface rubber layer laid on said compressive layer through a supporting body which is laid on said compressive layer, wherein said compressive layer is separated by a separation layer, which is formed by one or more layers of elastomer, so as to be divided into two layers of a first compressive layer and second compressive layer, so as to absorb normal printing pressure at the first compressive layer and to absorb rapidly applied over-printing pressure at the second compressive layer, an air space amount of said first compressive layer is 0.10-0.20 mm while a total air space amount of the first and second compressive layers is 0.25 mm or more, and a hardness of said separation layer is 70 JIS-A-80 JIS-D and a thickness of said separation layer is 0.05 mm or more.

2. The printing blanket according to claim 1, wherein said compressive layer divided into two layers is formed such that each has a different amount of an air space.

3. The printing blaket according to claim 1 wherein said separation layer is formed by at least one layer of elastomer.

4. The printing blaket according to claim 2, wherein said separation layer is formed by at least one layer of elastomer.

5. The printing blanket according to claim 1 wherein said compressive layer has a matrix hardness of 50-90 JIS-A.

6. The printing blanket according to claim 2, wherein said compressive layer has a matrix hardness of 50-90 JIS-A.

* * * * *